US007399390B2

(12) United States Patent
Ueichi

(10) Patent No.: US 7,399,390 B2
(45) Date of Patent: Jul. 15, 2008

(54) BARREL PLATING DEVICE

(76) Inventor: Kazuyoshi Ueichi, 2-15-15, Hachimangi, Hatogaya-shi, Saitama 334-0012 (JP)

( * ) Notice: Subject to any disclaimer, the term of this patent is extended or adjusted under 35 U.S.C. 154(b) by 782 days.

(21) Appl. No.: 10/766,331

(22) Filed: Jan. 29, 2004

(65) Prior Publication Data

US 2007/0151843 A1 Jul. 5, 2007

(30) Foreign Application Priority Data

Jun. 30, 2003 (JP) ..... 2003-188865

(51) Int. Cl.
*C25D 17/00* (2006.01)

(52) U.S. Cl. ..... 204/213; 204/212

(58) Field of Classification Search ..... 204/199, 204/212, 213, 214, 230.4
See application file for complete search history.

(56) References Cited

U.S. PATENT DOCUMENTS 2,762,772 A * 9/1956 Jackson ..... 204/213
2,830,946 A * 4/1958 Pleadwell ..... 204/222
3,427,034 A * 2/1969 Lowe ..... 277/560
4,105,526 A * 8/1978 Lewellen et al. ..... 204/213

FOREIGN PATENT DOCUMENTS

JP 2002-256500 * 11/2002

* cited by examiner

*Primary Examiner*—Nam Nguyen
*Assistant Examiner*—Luan V. Van
(74) *Attorney, Agent, or Firm*—Bacon & Thomas, PLLC

(57) ABSTRACT

A barrel plating device is disclosed, wherein hollow support shafts placed to be approximately level with each other are mounted in a piercing form to support members combined together to face each other at a prescribed interval, the opposite ends of a barrel having a hollow drum part whose opposite ends are closed with end plates are supported to the above support shafts in a rotatable condition, a lead wire having an electrode at a tip end and coated with an insulation layer is inserted in watertight and non-rotatable conditions into a hollow part of each support shaft in such a manner as to allow the above lead wire to pierce through the corresponding end plate of the barrel, and a collar formed with a low friction member is mounted to each lead wire portion that pierces through the above corresponding end plate of the barrel.

9 Claims, 10 Drawing Sheets

BARREL PLATING DEVICE

BACKGROUND OF THE INVENTION

1. Field of the Invention

This invention relates to a barrel plating device.

2. Description of the Related Art

In a barrel plating device that is to apply plating to works of a length as small as 0.2 to 1 mm, for instance, it is important to prevent the small works from entering each clearance (specifically, a bearing portion) between a lead wire of an electrode (specifically, a cathode) mounted to an inter-opposite end rotation center of a barrel and an insertion hole adapted to permit insertion of the lead wire, while the barrel plating device is in operation. This is because the electrode lead wire is inserted into each electrode lead wire bearing portion to ensure that the above lead wire may not rotate for the rotating barrel, so that entering of the small works into the above bearing portion causes damages to a coated insulation layer on the above lead wire and an inside face of the above insertion hole or obstruction to rotation of the barrel.

In Japanese Patent Laid-open No. 2002-256500, for instance, there is described a bearing part constitution of the barrel plating device as shown in FIG. 11.

The barrel plating device shown in FIG. 11 has a barrel holding frame 2*a* obtained by interconnecting a pair of support members 20*a* facing each other at a prescribed interval with a plurality of connecting bars. Tubular support shafts 4*a* are respectively mounted in a piercing form to the support members 20*a* with screws 44*a* so as to be located on the same horizontal axis.

A barrel 3*a* is composed of a hollow drum part (of a hexagonal prism shape, for instance) (not shown) and end plates 31*a* respectively fixed to the drum part so as to close the opposite ends of the drum part. A pivotally movable cover is mounted to one side surface of the drum part. The barrel drum part is a part obtained by combining, into a unit, porous plates having a large number of small holes adapted to permit permeation of a plating solution.

The opposite ends of the barrel 3*a* that is in an inclined position to a horizontal rotation axial center by about 11 degrees in a vertical direction are supported with the support shafts 4*a* in a rotatable condition. Specifically, a boss-shaped member 31*b* fixed to the bearing portion of each barrel end plate 31*a* is mounted to an oppositely facing-side end of the corresponding support shaft 4*a* through a super-high density polyethylene bearing 49*a* in a rotatable condition. In addition, an end gear 60*a* of a rotation transmitting means adapted to transmit rotation from a motor (not shown) to the barrel is fixed in a vertical position to one boss-shaped member 31*b*.

Each tubular support shaft 4*a* has a hollow part 40*a* composed of a distal end-side large inside diameter part 40*b* and an oppositely facing side-end small inside diameter part 41*a*. A super-high density polyethylene bush 32*a* mounted to each barrel end plate 31*a* has an insertion hole 32*b* so as to have the same axis as an axis of the hollow part 40*a* of each support shaft 4*a*.

An electrode lead wire 10*a* is inserted into the hollow part 40*a* of each support shaft 4*a* and the insertion hole 32*b* of each bush 32*a* so as to extend from the outside of the corresponding support member 20*a* into the barrel. In an inserted condition of each lead wire 10*a* as described above, an inside diameter of the above small inside diameter part 41*a* is sized so that an outside surface of the above lead wire 10*a* closely contacts, and an inside diameter of the insertion hole 32*b* is sized so that any work may not flow into a clearance between an inside surface of the above insertion hole 32*b* and the outside surface of the above lead wire 10*a*.

The outside surface of each lead wire 10*a* is coated with an insulation layer consisting of rubber. The above lead wire 10*a* has a downwardly bent part at a portion inside the barrel, and an electrode (specifically, a cathode) is connected to a tip end of the downwardly bent part.

An electrode lead wire mounting structure at the other end of the barrel is the same as the mounting structure shown in FIG. 11, except that the support shaft 4*a* at the other end of the barrel is sized to be shorter than that shown in FIG. 11, because of no need for the end gear 60*a* of the rotation transmitting means shown in FIG. 11.

When the above barrel plating device is used to apply plating to works composed of a microchip capacitor having a diameter of about 0.3 mm, for instance, the barrel cover is firstly opened to inject a prescribed amount of works and dummies into the barrel. Then, the barrel cover is closed, and the barrel is set, inclusive of the barrel holding frame 2*a*, in a plating tank to such a degree that the barrel gets immersed in a plating bath of the plating tank. Then, rotation of the barrel is started at a low speed with the electrodes energized. After plating to the works is finished, the barrel is transferred, inclusive of the barrel holding frame, from the plating tank to a cleaning bath for cleaning the works together with the dummies. Then, the works and the dummies are subjected to drying.

The above barrel plating device has no possibility of causing any work to flow into each clearance of the bearing portion, since each electrode lead wire is mounted as described above, and the inside diameter of the small inside diameter part 41*a* of each support shaft 4*a* is sized so that the outside surface of the above lead wire 10*a* closely, contacts, while the inside diameter of the insertion hole 32*b* is sized so that any work may not flow into the clearance between the inside surface of the above insertion hole 32*b* and the outside surface of the above lead wire 10*a*.

Thus, the above barrel plating device is supposed to be effective in preventing adverse effects caused by the fact that the works enter each clearance (such as each bearing portion clearance) between the insertion hole 31*b* and the lead wire 10*a*, specifically, adverse effects such as damages to the coated insulation layer on the above lead wire 10*a*, obstruction to smooth rotation of the barrel and unsatisfactory plating caused by the fact that the works remaining in the above clearance are mixed with later injected works, for instance.

However, according to the above barrel plating device, the lead wire insulation layer in the bearing portion has low molding accuracy and high coefficient of thermal expansion. Thus, when the above barrel plating device is used to apply plating to works of a length as small as 0.2 to 1 mm, for instance, it is difficult to control the inside diameter of the insertion hole 32*b* of the bush 32*a* in each barrel side plate to attain an inside diameter as much as a size, which ensures that the above works or a part thereof may not enter the clearance between the inside surface of the above insertion hole 32*b* and the above lead wire 10*a*, specifically, each bearing portion clearance, in consideration of the low molding accuracy and the coefficient of thermal expansion of the insulation layer.

Consequently, when appropriate control of the size of the insertion hole 32*b* of each bush 32*a* is not attainable so that the above insertion hole 32*b* remains small-sized, the above barrel plating device develops such adverse effects that the clearance between the inside surface of the above insertion hole 32*b* and the outside surface of the above lead wire 10*a* becomes larger in size due to wear of the insulation layer of the above lead wire 10*a* so that the works or the part thereof enters the above clearance, in addition to disadvantages of making rotation of the barrel difficult due to severe friction between the inside surface of the above insertion hole 32*b* and the outside surface of the above lead wire 10*a* when the barrel is in rotation. On the contrary, when appropriate control of the size of the insertion hole 32*b* is not attainable so that the above insertion hole 32*b* remains large-sized, the above barrel plating device also develops such adverse effects that the works or the part thereof enters the above clearance when the barrel is in rotation.

The works or the part thereof enters each clearance between the insertion hole 32*b* and the lead wire 10*a* and is stuffed in the above clearance, resulting in adverse effects such as damages to the coated insulation layer on the above lead wire 10*a*, non-smooth rotation of the barrel and degraded plating homogeneity caused by the fact that the works stuffed in the above clearance remain within the barrel when takeout of the works from the barrel is performed after plating.

SUMMARY OF THE INVENTION

An object of the present invention is to provide a barrel plating device, which is effective in sufficiently protecting an electrode lead wire insulation layer in a bearing portion where an electrode lead wire pierces through an end plate of a rotating barrel, and also in easily controlling a clearance size of the above bearing portion so that small works or a part thereof may not enter a clearance of the above bearing portion.

To attain the above object, a barrel plating device according to the present invention is characterized in that hollow support shafts placed to be approximately level with each other are mounted in a piercing form to support members combined together to face each other at a prescribed interval; the opposite ends of a barrel having a hollow drum part whose opposite ends are closed with end plates are supported with the support shafts in a rotatable condition respectively; a lead wire having an electrode at a tip end and coated with an insulation layer is inserted in watertight and non-rotatable conditions into a hollow part of each support shaft in such a manner as to allow the above lead wire to pierce through the corresponding end plate of the barrel; and a collar formed with a low friction member is mounted to each lead wire portion that pierces through the above corresponding end plate.

BRIEF DESCRIPTION OF THE DRAWINGS

The foregoing and other objects and features of the invention will become more apparent in the following description of the preferred embodiments of the invention taken in conjunction with the accompanying drawings, in which.

DETAILED DESCRIPTION OF THE PREFERRED EMBODIMENTS

First Embodiment

Firstly, an outline of a barrel plating device according to the present invention is described with reference to FIGS. 1 and 2.

Figure 1:
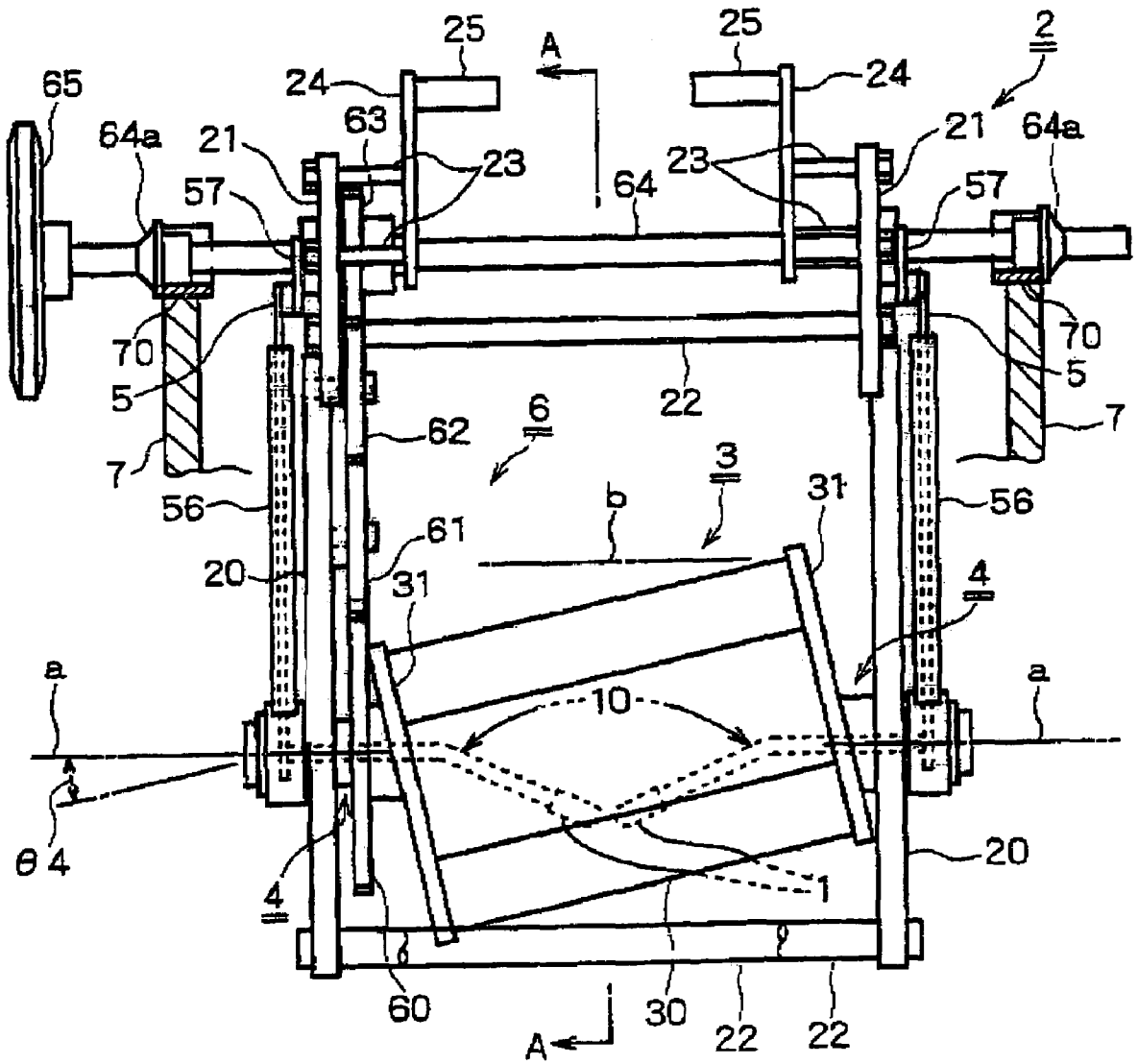
FIG. 1 is a partly omitted front view showing a first embodiment of a barrel plating device according to the present invention.
Figure 2:
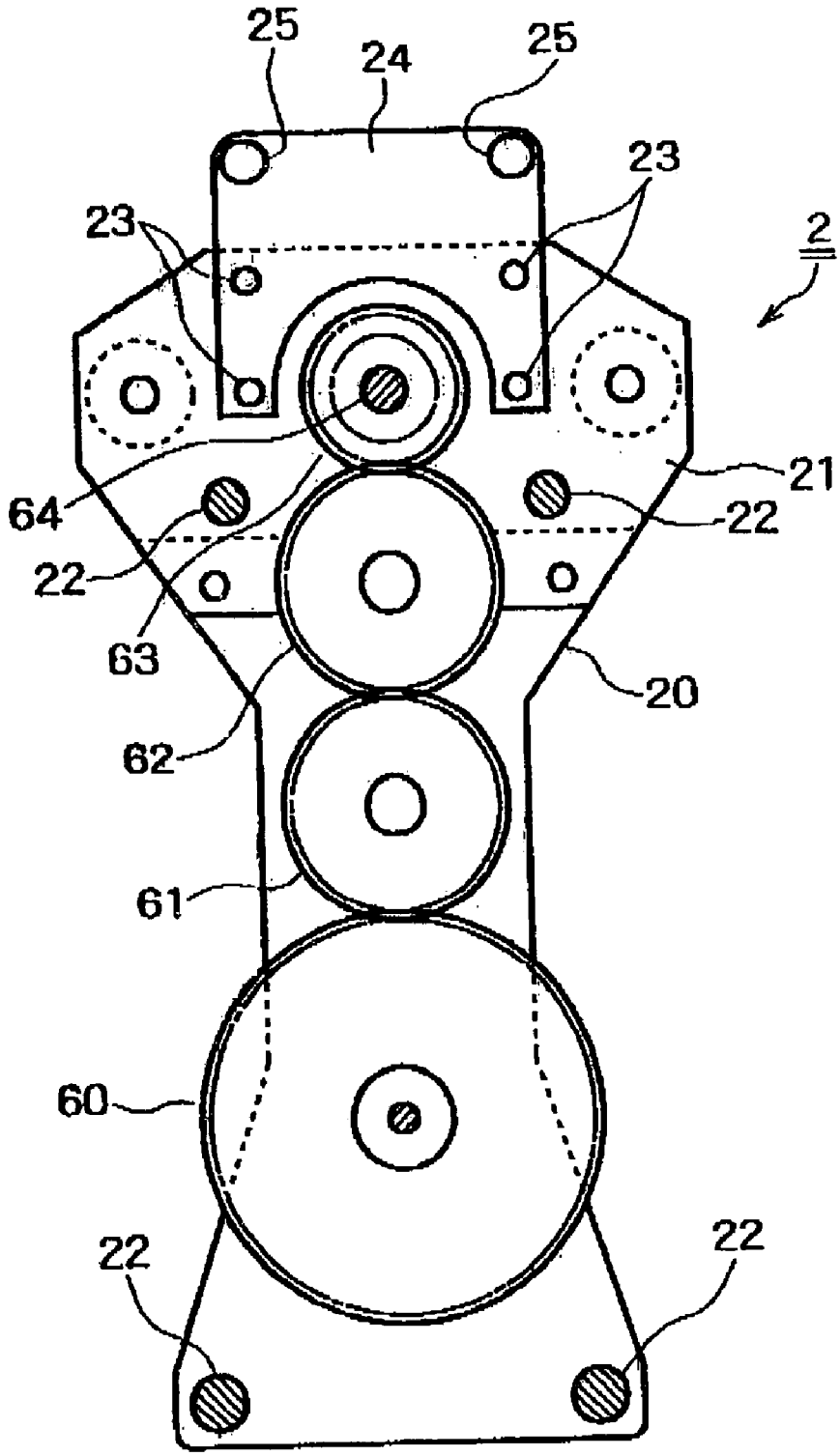
FIG. 2 is an enlarged sectional view taken along an arrow A-A in FIG. 1 with a barrel omitted.

As shown in FIGS. 1 and 2, the barrel plating device according to the present invention has a barrel holding frame 2 obtained by interconnecting support members 20, 20 facing each other at a prescribed interval with several pieces of connecting bars 22. The barrel holding frame 2 is housed in a plating tank 7. An upper support plate 21 is mounted to an upper part of each support member 20.

Hollow support shafts 4 are respectively mounted at the same level to portions close to a lower part of each support member 20 so as to extend in a piercing form from the outside. The opposite ends of a barrel 3 are respectively mounted to both the support shafts 4 in a rotatable condition, and lead wires 10 of electrodes (specifically, cathodes) 1 are respectively inserted into the above support shafts in watertight and non-rotatable conditions.

The barrel 3 is composed of a hollow drum part 30 obtained by combining, into a polygonal-shaped unit (a hexagonal-shaped unit in the first embodiment), hard synthetic resin porous plates (not shown) having a large number of densely arranged small holes, and end plates 31, 31 formed with porous plates of the similar quality to the above and fixed to the opposite ends of the drum part 30 so as to close the above opposite ends.

A cover (not shown) formed with a porous plate of the similar quality to the above is mounted to one side surface of the drum part 30 in a pivotally movable condition.

A net (not shown) of small meshes is fixedly mounted to the inside of each side surface of the drum part 30, inclusive of the side surface mounted with the cover.

Each lead wire 10 is connected, at an outer end projecting outwards from the inside of the corresponding support member 20, to a plate-shaped energizing member 5 provided to downwardly extend along the side of the above support member 20. Each joint part between the energizing member 5 and the above outer end of the lead wire 10 is covered in a watertight condition.

Each energizing member 5 is covered, at a portion excepting an upper part thereof, with an insulation member 56 to ensure that at least an energizing member portion lower than a level b of a plating solution in the plating tank 7 is insulated from the plating solution, with the barrel holding frame 2 housed in the plating tank 7.

An upper part of each energizing member 5 is connected in the shape of a letter T to an energizing plate 57 mounted to a side of each upper support plate 21 of the barrel holding frame 2, thus allowing direct current to be supplied to the respective electrodes 1 through the energizing plates 57, the energizing members 5 and the lead wires 10.

Reference numeral 6 denotes a rotation transmitting means for transmitting rotation of a motor (not shown) to the barrel 3. The rotation transmitting means 6 is composed of a rotating shaft 64 mounted to the upper support plates 21 in a rotatable condition so as to pierce through each upper support plate 21, a gear 65 fixed to one end of the rotating shaft 64 and a train of gears.

The train of gears is composed of a gear 63 fixed to the rotating shaft 64, intermediate gears 62, 61 respectively mounted to the inside of one support member 20 (specifically, the left-side support member in FIG. 1) in a rotatable condition and an end gear 60 mounted to one support shaft 4 in a rotatable condition so that the end gear 60 and one end plate 31 of the barrel 3 may rotate as a unit through a boss-shaped member.

Available materials of the gears 60 to 64 include a hard synthetic resin.

Bearing members 64*a*, 64*a* are respectively mounted to the rotating shaft 64 in a rotatable condition so as to be located at the opposite sides of an upper part of the barrel holding frame 2. On the contrary, receiving tools 70, 70 respectively adapted to receive the bearing members 64*a*, 64*a* are mounted to the opposite upper edges of the plating tank 7. Thus, mounting of the rotating shaft 64 in such a manner as to locate the rotating shaft 64 across the opposite upper edges of the plating tank 7 with the bearing members 64*a*, 64*a* conducted to the corresponding receiving tools 70, 70 allows the barrel holding frame 2 to be housed in the plating tank 7 in an appropriate position in a suspended form. As a result, the barrel 3 held with the barrel holding frame 2 gets submerged under the plating solution by an appropriate depth.

Mounting plates 24, 24 are respectively mounted in a vertical position to the oppositely facing sides of the upper support plates 21, 21 through a plurality of connecting bars 23. Also, grip bars 25, 25 are respectively mounted in a horizontal position to the mounting plates 24, 24 so as to extend in parallel at the same level. For transfer of the barrel holding frame 2 from the plating tank 7 to a different place or from the different place into the plating tank 7, the grip bars 25 are adapted to transfer the barrel holding frame 2 in a lifted-up manner by hooking the grip bars 25 with a carrying device (not shown).

The barrel 3 is mounted to the support shafts 4 in a condition where the drum part 30 of the barrel 3 is inclined to a horizontal rotation axis a shown in FIG. 1 by a prescribed angle θ4 in a vertical direction and also forms a prescribed angle in a horizontal direction to the above rotation axis. With the barrel 3 mounted as described above, preferred work moving or mixing attained inside the barrel 3 with rotation of the barrel 3 is accelerated.

A vertical inclination and a horizontal angle of the drum part 30 to the rotation axis a are determined depending on a capacity of the barrel 3, a work size (inclusive of a dummy size when dummies are required), an amount of works injected into the barrel 3 and other specific requirements. Specifically, as a general criterion, it is preferable to determine both the vertical inclination and the horizontal angle to fall in the range of not more than 15 degrees to the rotation axis a. This is because when the vertical inclination of the barrel 3 is more than the above angle, acceleration of moving or mixing of plating objects injected into the barrel 3 becomes unattainable, resulting in no smooth rotation of the barrel.

In the first embodiment, the drum part 30 of the barrel 3 is in an inclined position to the rotation axis a by about 12 degrees in both the vertical and horizontal directions.

Details of each electrode lead wire are described in the following with reference to FIG. 3.

Figure 3:
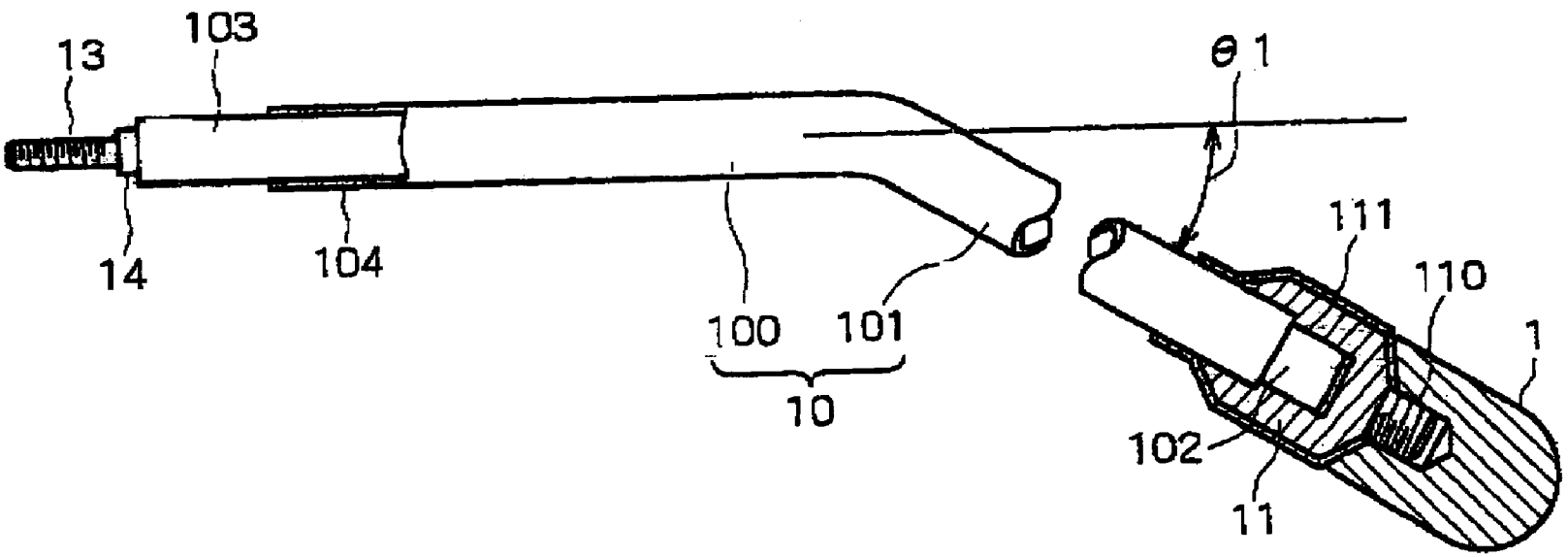
FIG. 3 is a partly broken front view showing an electrode lead wire.

As shown in FIG. 3, each lead wire 10 is a satisfactorily conductive hard round bar such as a copper bar. Specifically, the above lead wire 10 is an integral unit composed of a shaft part 100 of a prescribed length and a downwardly bent part 101 that takes a forwardly downward slanting shape by gravity when the shaft part 100 is held in a horizontal position.

The shaft part 100 has a distal end side having a connection part 13 comprising a small-diameter external thread formed as an integral part of the shaft part 100 through a non-circular part 14 having a non-circular sectional shape. The downwardly bent part 101 has a tip end side connected to the electrode 1 such as the copper electrode through a satisfactorily conductive connection piece 11. Each lead wire 10 is partly coated with an insulation layer 104 such as a plastic layer, excepting a distal end-side bare part 103 including the connection part 13 and a tip end-side bare part 102.

The connection piece 11 has a distal end side fixed (or caulked) to a tip end portion of the downwardly bent part 101, inclusive of the bare part 102, in a buried form. The connection piece 11 also has a gently inclined conical surface-shaped tip end having a small-diameter external thread part 110 in the center. The connection piece 11 is partly coated with an insulation layer 111 such as a plastic layer, excepting the external thread part 110. The electrode 1 in the shape of a cap nut is mounted to the external thread part 110 by screwing, so that a concavely conical-shaped distal end surface of the above electrode 1 is pressed against the insulation layer 111 of the tip end of the connection piece 11.

Pressing of the connection piece 11 and the electrode 1 with a conical surface that extends in the shape of a convex toward the tip end and sizing of an outside diameter of the electrode 1 so as to be slightly smaller than that of the connection piece 11 including the insulation layer 111 are adapted to prevent plating wastes and the small works from being adhered to the outer circumference of each contact portion between the connection piece 11 and the electrode 1, with the result that an increased life of the electrode 1 is attainable.

The downwardly bent part 101 is obtained by subjecting each lead wire to bending in the forwardly downward slanting shape for the shaft part 100 with the above shaft part 100 held in a horizontal position. However, a bending angle θ1 (strictly speaking, an angle obtained by an axis of the shaft part 100 and a line that connects the tip end center of the electrode 1 and the center of a bending start portion specified as a boundary between the shaft part 100 and the downwardly bent part 101) of the downwardly bent part 101 for the shaft part 100 varies depending on a sectional area and a capacity of the drum part 30 of the barrel 3, a length of the shaft part 100, an amount of works (inclusive of dummies when mixing of the works with the dummies is required) injected into the barrel 3 and other requirements. As a general criterion, the above bending angle θ1 is preferably in the range of about 25 to 60 degrees.

Each electrode 1 is mounted to the tip end of the downwardly bent part 101 of each lead wire 10 through the connection piece 11 enclosed with the insulation layer 111 in order to enable the electrode 1 to be replaced with new one when severe wear of the above electrode 1 is caused. Alternatively, the electrode may be the tip end-side bare part 102 of each lead wire 10.

Details of each electrode lead wire mounting part are described in the following.

Figure 4:
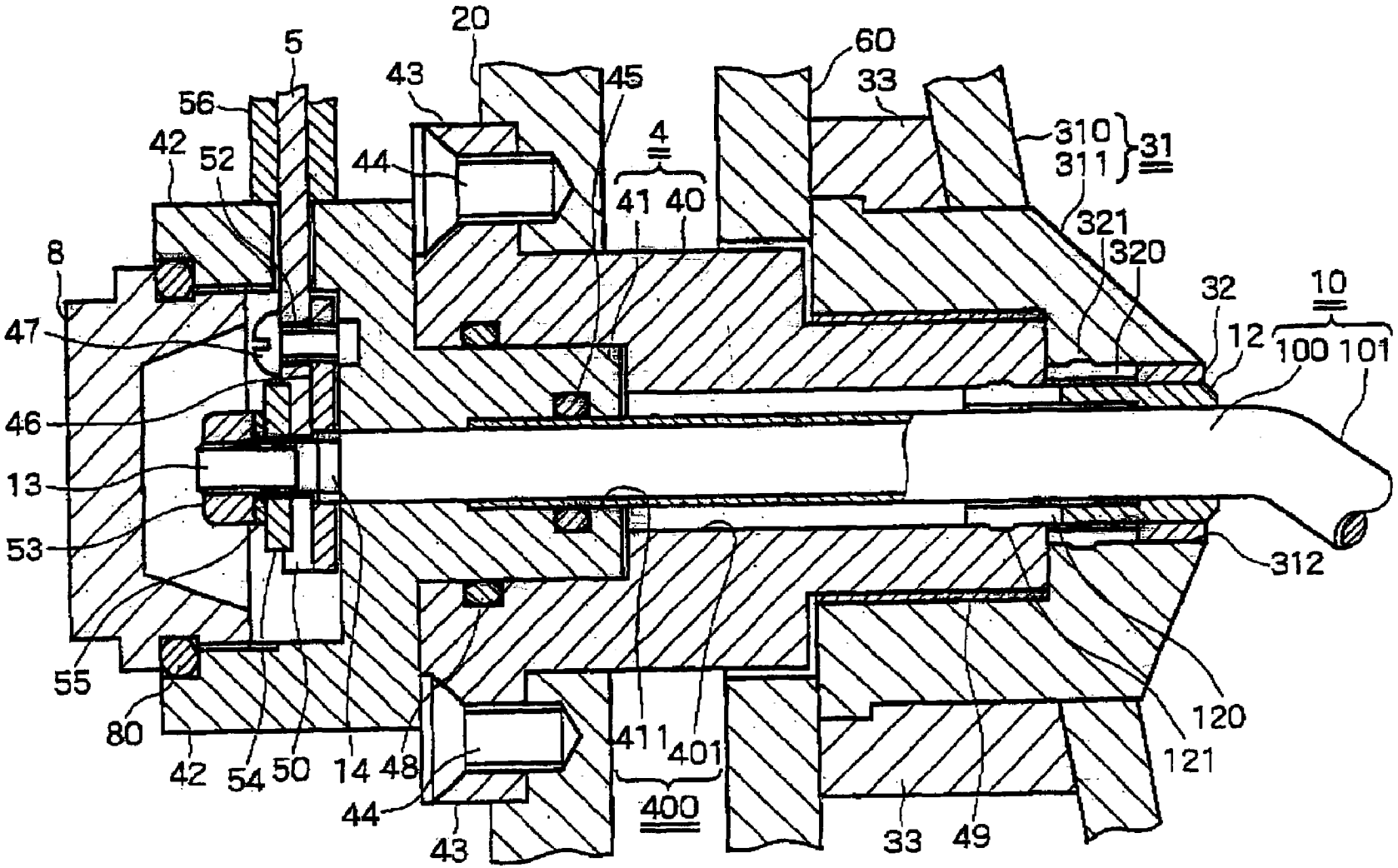
FIG. 4 is a partly enlarged sectional view showing details of a mounting structure of one (left-side) electrode lead wire of the barrel plating device shown in FIG. 1.
Figure 5:
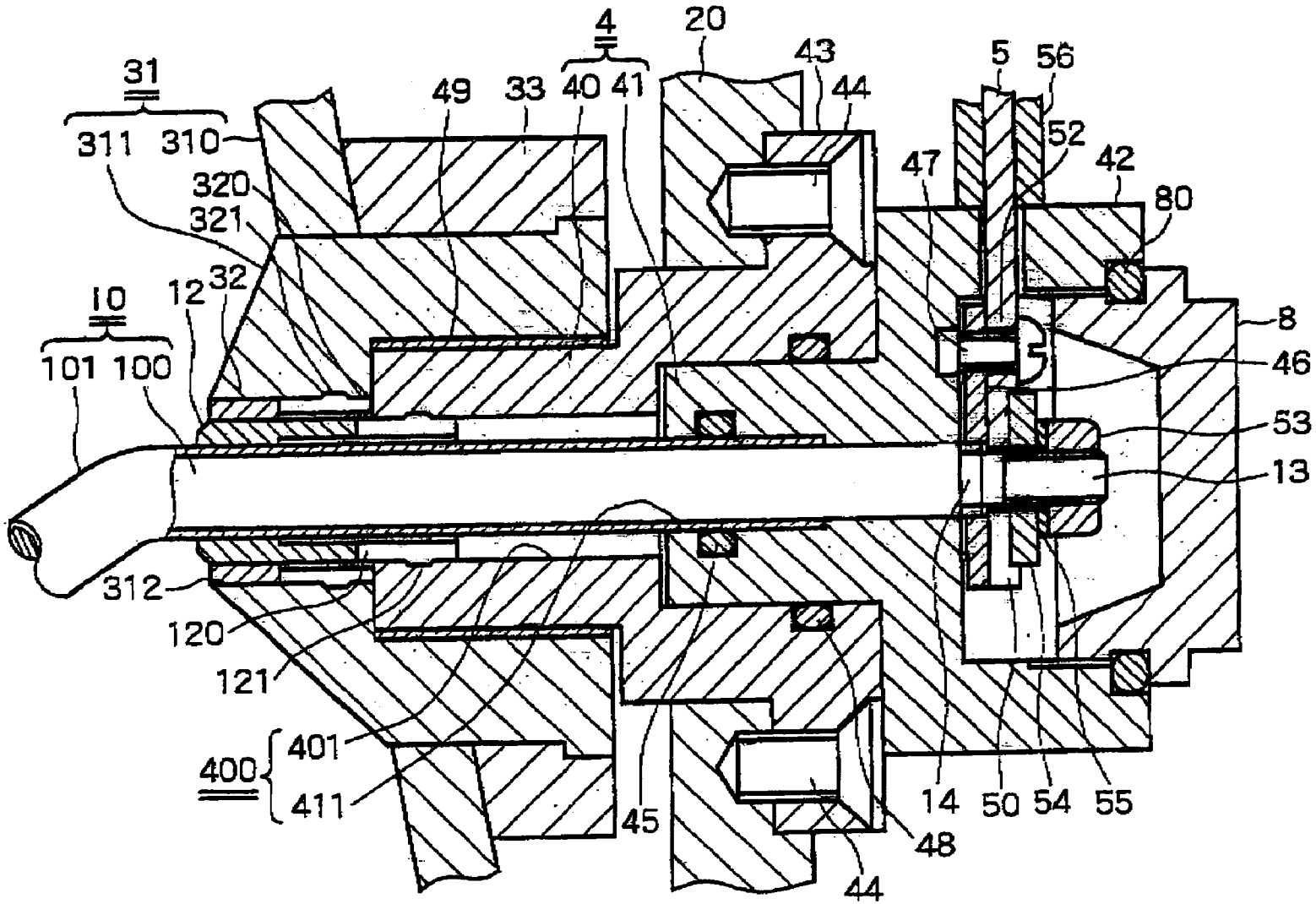
FIG. 5 is a partly enlarged sectional view showing details of a mounting structure of the other (right-side) electrode lead wire of the barrel plating device shown in FIG. 1.

As shown in FIGS. 4 and 5, the hollow hard synthetic resin support shafts 4, 4 are respectively mounted to positions close to the lower part of each support member 20 in a condition where mutual axes of the support shafts 4 horizontally face each other and where the support shafts 4 extend in a piercing form from the outside through the above support members 20 at right angles.

Each support shaft 4 is composed of a shaft body 40 having a flange 43 at one end and a connection part cover 41 for the lead wire 10 whose part is press-fitted in a buried form from the outside into the shaft body 40. The connection part cover 41 has an outside end having a deep dish-shaped housing part 42. A watertight condition between the shaft body 40 and the connection part cover 41 is obtained with a seal ring 48 interposed between the shaft body 40 and the connection part cover 41.

The support shafts 4 are respectively fixed to the corresponding support members 20 in such a manner as to mount the flange 43 of the shaft body 40 of each support shaft to the corresponding support member 20 with the proper number of screws 44.

The end gear 60 of the rotation transmitting means 6 is mounted to one support shaft 4 (See FIG. 4), so that the above one support shaft 4 is sized to be longer than the other support shaft 4 (See FIG. 5).

Each support shaft 4 has a hollow part 400 composed of a large inside diameter part 401 specified as a hollow part of the shaft body 40 and a small inside diameter part 411 specified as a hollow part of the connection part cover 41. The large inside diameter part 401 is sized to approximately match an outside diameter of each collar 12 as described later, while the small inside diameter part 411 is sized to approximately match an outside diameter of the shaft part 110 of each lead wire 10.

Each end plate 31 of the barrel is composed of a body 310 that forms an outside ring and a boss-shaped member 311 that forms a bearing part. The boss-shaped member 311 of each end plate 31 is mounted in a rotatable condition to the tip end-side outer circumference of the corresponding shaft body 40 through a sheet-shaped bearing 49 formed with a low friction member.

A housing part 33 adapted to cover the corresponding boss-shaped member 311 in such a manner as to also serve as a spacer is mounted to the body 310 of each end plate 31. The end gear 60 is mounted to the boss-shaped member 311 of one end plate 31 (See FIG. 4) and the housing part 33 so that the end gear 60 and the above one end plate 31 may rotate as a unit without interfering with the corresponding support shaft 4.

Each end plate 31 has an insertion hole 312 in the boss-shaped member 311, and the bush 32 is fixedly inserted into the above insertion hole 312. Available materials of the bush 32 include polyacetal (such as "Duracon" that is a trade name of a product manufactured by Polyplastics Co. Ltd., for instance) and other low friction members, specifically, a member having relatively low coefficient of thermal expansion.

Figure 6:
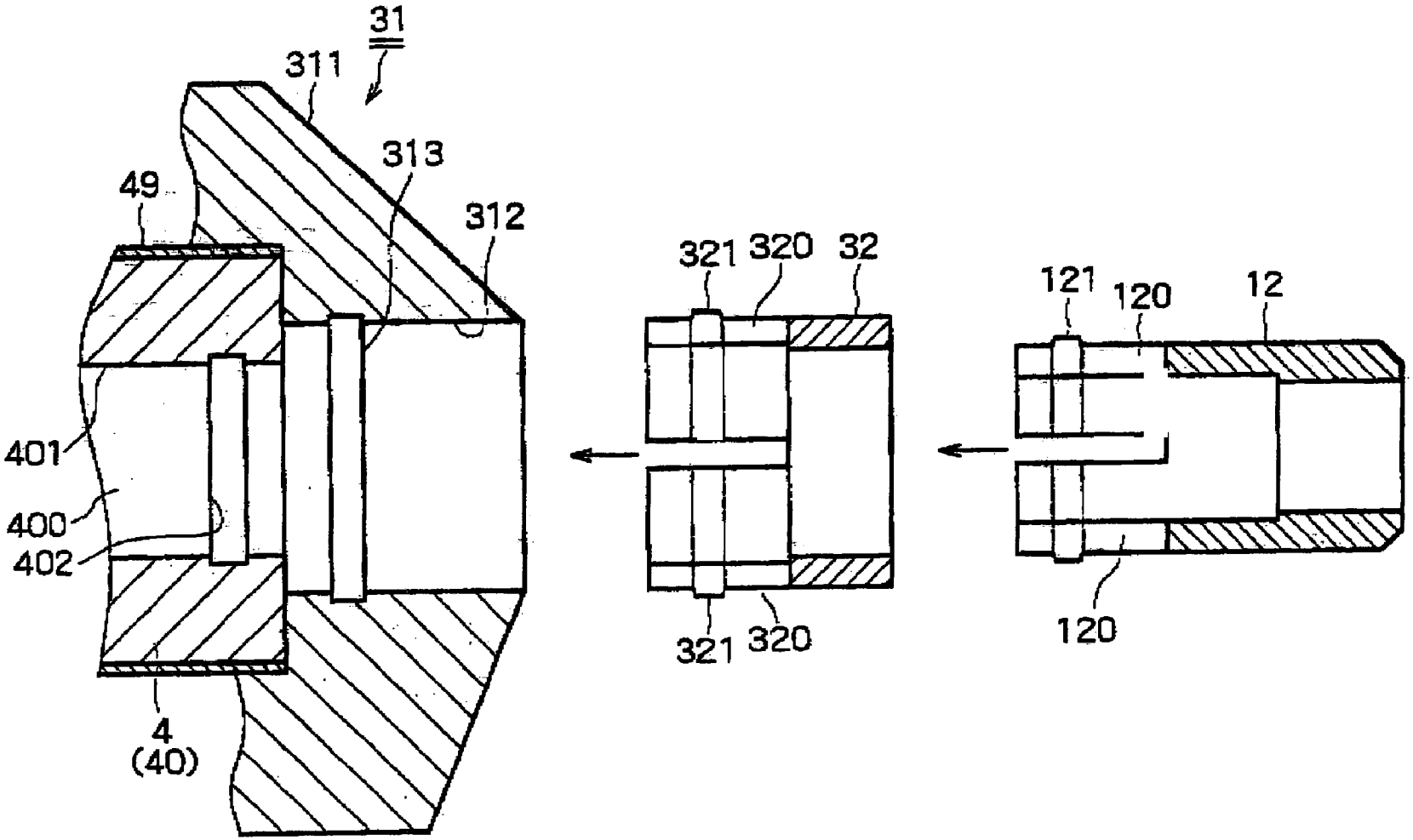
FIG. 6 is a partly enlarged exploded sectional view showing an electrode lead wire mounting structure portion in the barrel plating device shown in FIG. 1.

As shown in an exploded form in FIG. 6, each cylindrical bush 32 in the first embodiment has, in a portion facing an end of the barrel, slots 320 radially spaced at a prescribed angle (such as 90 degrees in the first embodiment). The inside diameter of a slotted portion of the above bush 32 is sized to be slightly larger than that of the other portion and the slotted portion has a flange-shaped projection 321 around its outer circumference. The insertion hole 312 has a ring-shaped groove 313 around its inner circumference so as to mate with the above projection 321. Engagement of the projection 321 of each bush 32 with a groove 313, by thrusting the bush 32 into the insertion hole 312, serves to hold the bush 32 in the insertion hole 312.

The shaft part 100 of each lead wire 10 is inserted into the hollow part 400 of each support shaft 4 through the above bush 32 of each end plate 31 to ensure that the connection part 13 runs out into the housing part 42 of the above support shaft 4. The shaft part 100 is partly inserted into the small inside diameter part 411 of the above support shaft 4 in a close contact condition. Also, a watertight condition between the shaft part 100 and the small inside diameter part 411 of the above support shaft 4 is maintained with a seal ring 45 interposed between the shaft part 100 and the above small inside diameter part 411.

In the first embodiment, the collar 12 is fixedly mounted to a corresponding portion of the shaft part 100 to the above bush 32, thus allowing the inside surface of the bush 32 to slide on the outside surface of the above collar 12 when the barrel is in rotation. Available materials of the collar 12 include a super high-density synthetic polymer material (such as super-high density polyethylene, for instance) and other low friction members, specifically, a member having relatively low coefficient of thermal expansion.

As shown in the exploded form in FIG. 6, each cylindrical collar 12 in the first embodiment has slots 120 spaced at a prescribed angle (such as 90 degrees in the first embodiment). An inside diameter of a slotted portion of the above collar 12 is sized to be slightly larger than that of the other portion, and the slotted portion has a flange-shaped projection 121 on an outer circumference. On the contrary, the large inside diameter part 401 of each support shaft 4 has a ring-shaped groove 402 on a tip end-side inner circumference so as to agree with the above projection 121. Engagement of the projection 121 of each collar 12 formed as described above with the groove 402 by making a thrust of the above collar 12 into the large inside diameter part 401 of the above support shaft 4 together with the corresponding lead wire 10 is adapted to hold the collar 12 in the large inside diameter part 401 of the above support shaft 4 in a non slipped-out condition.

Each electrode 1 has, at the bare part 103 of the shaft part 100, the non-circular part 14 as described above. A regulating plate 46 is mounted to each non-circular part 14 to ensure that the above regulating plate 46 and the shaft part 100 may rotate as a unit.

Each regulating plate 46 is used to regulate the corresponding lead wire 10 so as to lock the shaft part 100 thereof in such a manner as to fix the above regulating plate 46 to a lower end of each energizing member 5 as described later with a screw 47 with the above regulating plate 46 held in a desired position. The above regulating plate 46 is also used to regulate a position of the corresponding electrode 1 to ensure that the above electrode 1 is located at a position lower than the rotation axis a by a prescribed distance as shown in FIG. 1 and that the downwardly bent part 101 is inclined by a prescribed angle θ5 in a direction of rotation of the barrel 3 to the above rotation axis a in a section orthogonal to the shaft part 100.

With the lead wires 10, 10 installed as described above, a closely face-to-face condition of the electrodes 1, 1 is obtained at an average lengthwise center position of the barrel 3, as shown in FIG. 1.

Figure 8:
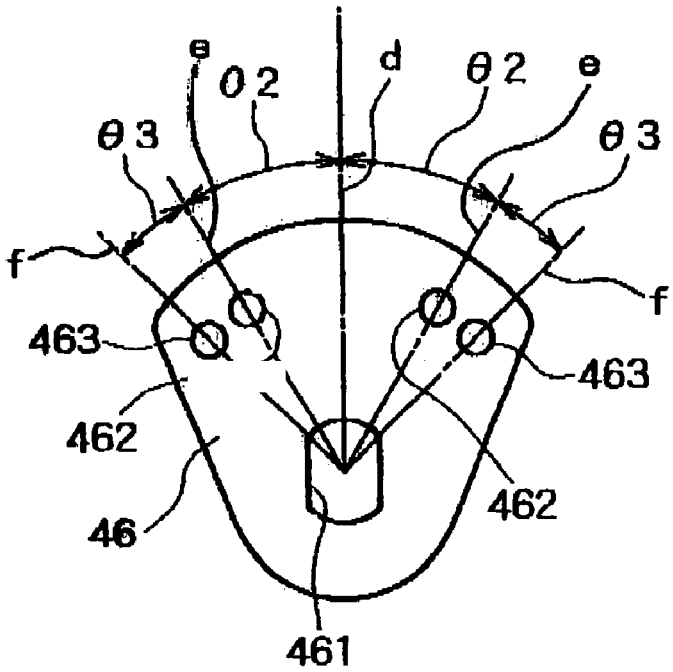
FIG. 8 is a front view showing a regulating plate used to lock the lead wire.

In the first embodiment, each regulating plate 46 is in the shape of a sector as shown in FIG. 8, and has, in the center of the sector shape, a long hole 461 that is sized to approximately match the non-circular part 14. The above regulating plate 46 also has, at the upper opposite sides of a centerline d of the sector shape, tapped regulating holes 462, 463 spaced at a prescribed angle.

Figure 9:
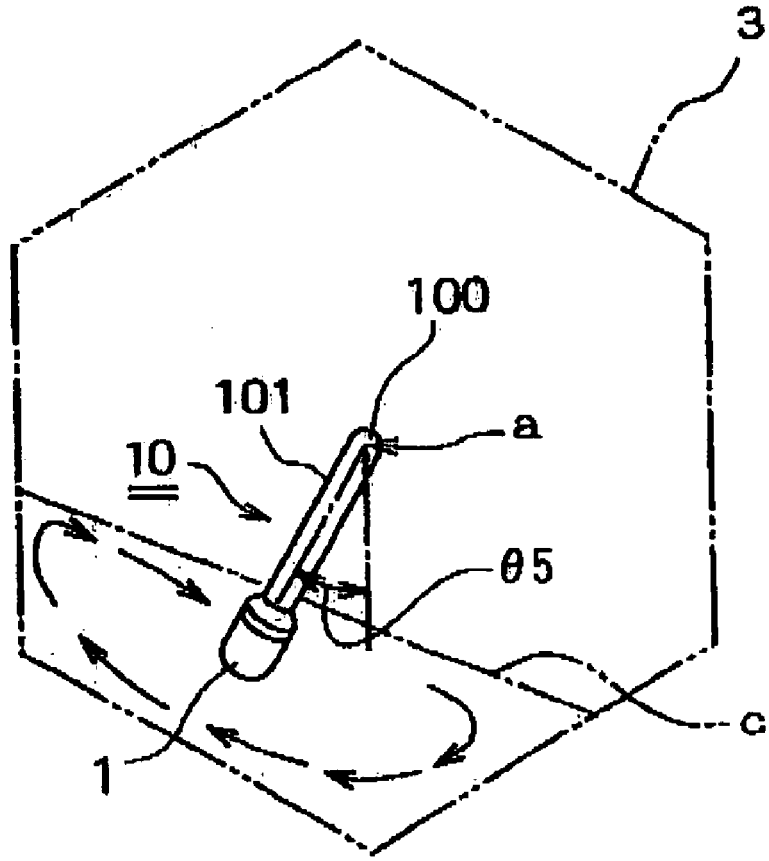
FIG. 9 is a side view showing the right-side lead wire of the barrel plating device shown in FIG. 1, as seen from a left direction.

Each regulating plate 46 is adapted to determine the inclination angle θ5 of the downwardly bent part 101 shown in FIG. 9 by mounting the above regulating plate 46 to the corresponding non-circular part 14 with the above non-circular part 14 passing through the elongate hole 461 of the above regulating plate 46, by selecting one of the regulating holes 462 and 463 to allow the selected one of the regulating holes to be located right above the non-circular part 14, and by screwing the machine screw 47 into the selected regulating hole 462 or 463 through a guide hole 52 formed in a portion close to a lower part of each energizing member 5 as described later.

In the first embodiment, an angle θ2 obtained by the above centerline d and each line e that connects the center (such as the rotation center of the sector shape) of the elongate hole 461 in each regulating plate 46 and the center of each regulating hole 462 next to the above centerline d as shown in FIG. 8 is set at 30 degrees. In addition, an angle θ3 obtained by each line f that connects the center of the elongate hole 461 and the center of each regulating hole 463 and each line e adjacent to the above line f is set at 15 degrees.

Thus, the inclination angle θ5 of the downwardly bent part 101 in FIG. 9 may be set at 30 or 45 degrees in a selective manner.

The appropriate level position of each electrode 1 and the appropriate inclination angle θ5 of the downwardly bent part 101 in the section orthogonal to the shaft part 100 in the direction of rotation of the barrel as described above vary depending on a sectional capacity of the drum part 30 of the barrel 3, a work size, an amount of works injected, a speed of rotation of the barrel 3 and other specific requirements.

As shown in FIG. 9, with clockwise rotation of the barrel 3, an upper surface of a small work group c, inclusive of dummy pieces, obtained by injection into the barrel 3 is brought, at the lengthwise center of the barrel 3, to a forwardly upward slanting condition in a direction of the above clockwise rotation. In this condition, the work group is moved for mixing as shown by an arrow in FIG. 9. Thus, it is preferable to select the level of each electrode 1 and the inclination angle θ5 in FIG. 9 to ensure that the downwardly moving works may contact the electrodes 1 uniformly as much as possible in the course of moving of the work group c.

As a criterion in outline, it is preferable to determine the inclination angle θ5 of the downwardly bent part 101 of each lead wire 10 in the direction of rotation of the barrel to fall in the range of 25 to 50 degrees.

Figure 7:
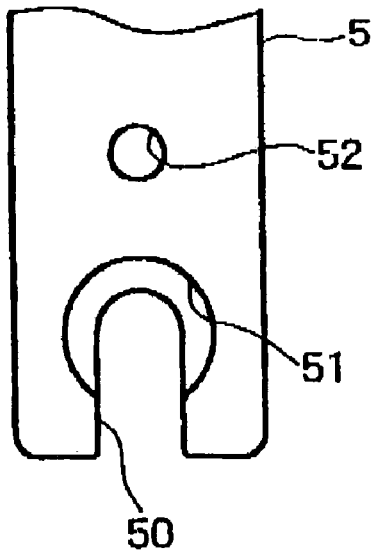
FIG. 7 is a front view showing a lower end portion of an energizing member.

As shown in FIG. 7, each energizing member 5 has, at a lower end portion with the insulation member 56 cut away, a notch-shaped guide part 50 communicating with the lower end and a spot facing-shaped seat part 51 located around an upper end of the above guide part 50. The lower end of each energizing member 5 is connected to the connection part 13 of each lead wire 10 with contact resistance electrically reduced by allowing the lower end of the above energizing member 5 to thrust downwardly into the corresponding housing part 42 in a watertight condition, by conducting the connection part 13 of the above lead wire 10 to the guide part 50 to allow the above connection part 13 to project from the above guide part 50 and by tightening a nut 53 to the above connection part 13 in a screwing manner through a brass or copper conductive contact plate 54 and a spring washer 55 respectively brought to the seat part 51*a*.

Each housing part 42 has an internal thread part on an inside surface of the tip end. Thus, each joint part between the connection part 13 of the lead wire 10 and the energizing member 5 is held in such a watertight condition as to be insulated from the other portion by tightening a hard synthetic resin screw cap 8 having an external thread part to the above housing part 42 in a screwing manner through a seal ring 80.

An operation of the above barrel plating device is described together with effects thereof in the following.

The cover is closed after injection of the proper amount of works into the barrel 3 together with the dummies. Then, as shown in FIG. 1, the barrel holding frame 2 is set in the plating tank 7 to such a degree that the barrel 3 gets submerged under the level b or below of the plating solution. Then, the barrel plating device applies plating to the works with the electrodes 1 energized, while allowing the barrel 3 to rotate in a speed decreasing manner through the rotation transmitting means 6.

Rotation of the barrel 3 causes the works to be sufficiently mixed, while being moved within the barrel 3 in a reciprocating manner along the drum part thereof. With the rotation of the barrel 3, contact of the works with the electrodes 1 is repeated to allow mixing of the works to be further accelerated.

According to the barrel plating device of the first embodiment, the collar 12 formed with the low friction member is mounted to each lead wire 10 in the bearing portion where the above lead wire 10 pierces through the corresponding end plate 31 of the barrel 3, so that it is possible to protect the insulation layer 104 of each lead wire 10 that is at the above bearing portion. In addition, the collar 12 and the insulation layer 104 of each lead wire 10 are separate members, so that a selection of a material having satisfactory workability and low coefficient of thermal expansion for the above collar may be adapted to easily control the clearance size of the above bearing portion to ensure that the small works or the part thereof may not enter the clearance of the above bearing portion.

The collar 12 and the lead wire 10 are separate members, so that easy replacement of the collar 12 is executable.

Each collar 12 has the axially extending slots 120 at the portion facing the outside of the barrel, the inside diameter of the slotted portion of the above collar 12 is sized to be slightly larger than that of the other portion, and a thrust of the above collar 12 into the large inside diameter part 401 of the tip end of each support shaft 4 is made in the non slipped-out condition so that the above collar 12 is mounted to each lead wire 10 and the tip end of the above support shaft 4, thereby providing a more stabled mounting condition (or a fixing condition) of the collars 12.

Each bush 32 is mounted to the insertion hole 312 of each end plate 31 of the barrel 3, so that no wear of the insertion hole 312 is created. Alternatively, when wear of the above bush 32 specified as the end plate 31-side bearing portion causes the clearance between the collar 12 and the above bush 32 to be expanded by an allowable distance or more, it is possible to easily repair the above bearing portion.

Each bush 32 has the slots 320 at the portion facing the outside of the barrel, the inside diameter of the slotted portion of the above bush 32 is sized to be slightly larger than that of the other portion, and a thrust of the above bush 32 into the end plate 31-side insertion hole 312 is made in the non slipped-out condition, thereby providing a more stabled mounting condition of the bushes 32, in addition to simple mounting of the bushes 32.

When the upper end of each energizing member 5 is brought to a free condition, simultaneously with removal of each screw 44, in such a manner as to size the inside diameter of each bush 32 or that of the insertion hole 312 of each end plate 31 in the absence of any bush 32 to be larger than the outside diameter of the connection piece 11 of each lead wire 10 by a required length, it is possible to draw out the lead wires 10, together with the support shafts 4 with the lead wires mounted thereto, from the end plates 31 of the barrel 3 and the support members 20 along the axial direction. Thus, a more easily partial repair is executable.

Second Embodiment

Figure 10:
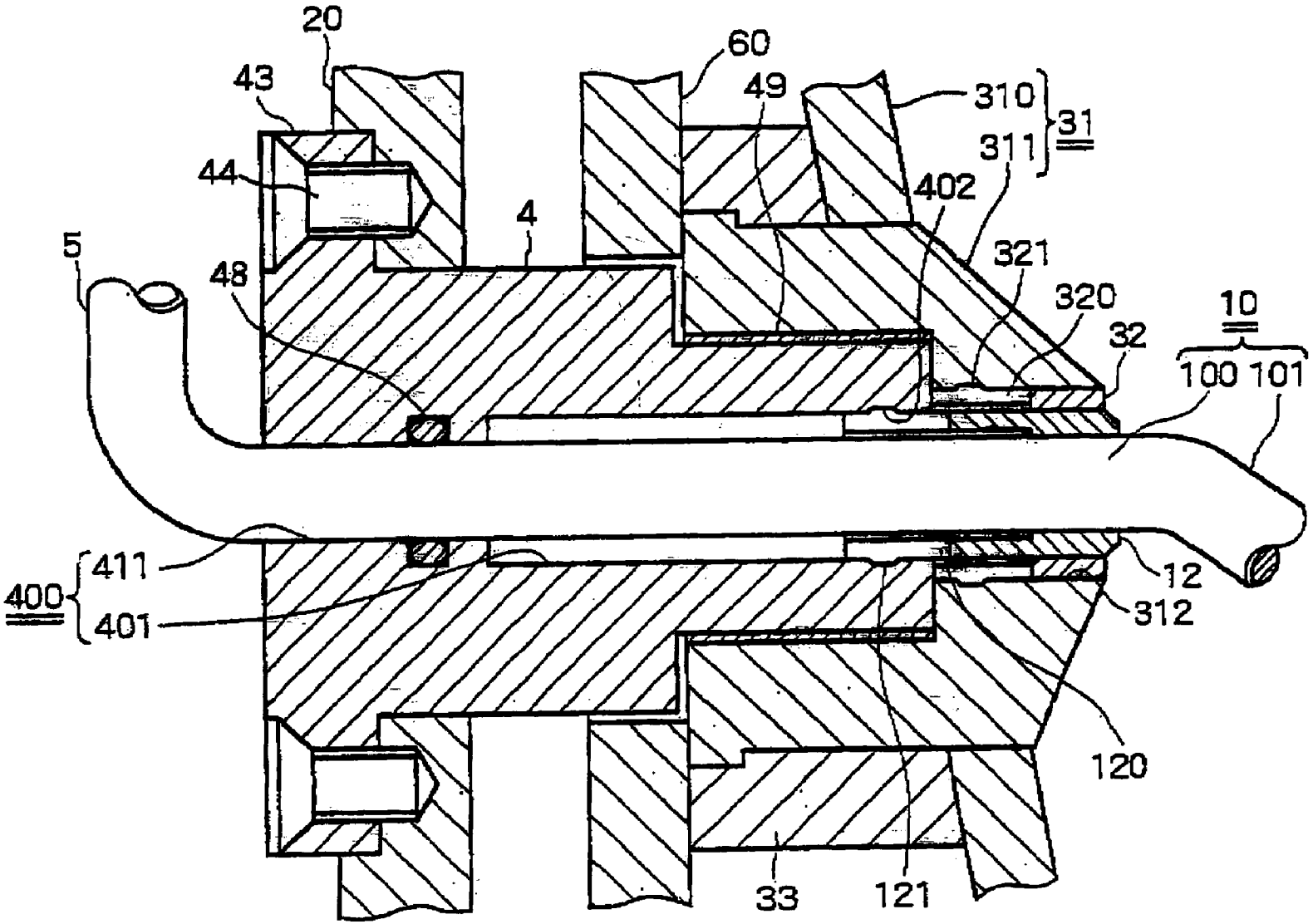
FIG. 10 is a partly enlarged sectional view showing a second embodiment of the barrel plating device according to the present invention.
Figure 11:
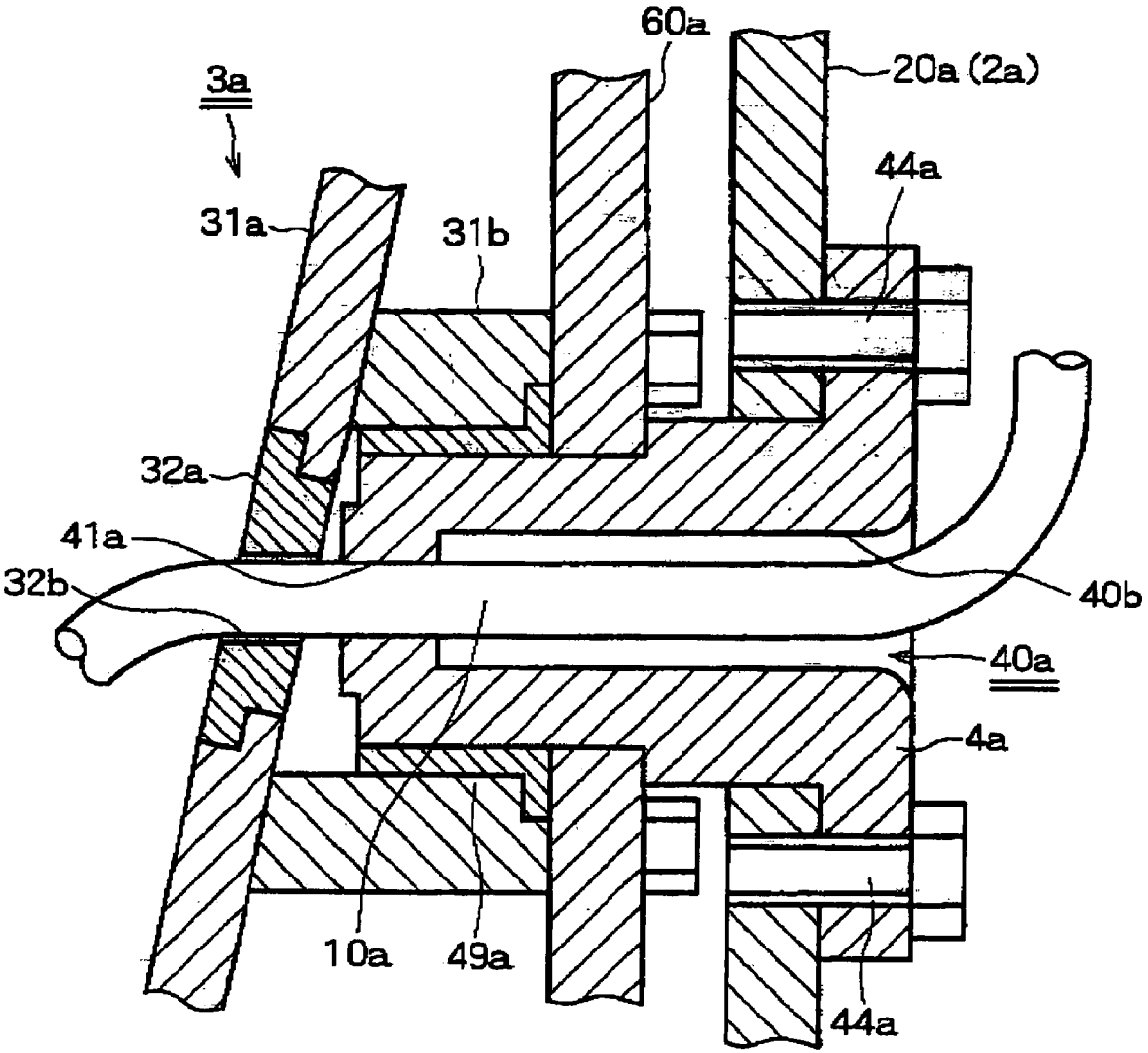
Fig. 11 (Prior Art)
FIG. 11 is a partly sectional view showing an electrode lead wire mounting structure described in Japanese Patent Laid-open No. 2002-256500.

FIG. 10 is a partly sectional view showing a second embodiment of the electrode lead wire mounting structure according to the present invention.

In the second embodiment, each lead wire 10 and the corresponding energizing member 5 in the first embodiment are formed as an integral unit, and are also combined with each support shaft 4 as an integral unit without providing any housing part 42.

Other constitution, operation and effects of the second embodiment are substantially similar to those of the first embodiment, and hence, detailed description thereof will be omitted.

OTHER EMBODIMENTS

In each of the above embodiments, the bush 32 is mounted to the insertion hole 312 of each end plate 31 of the barrel 3. Alternatively, with the bushes 32 omitted, the above insertion hole 312 may be adapted to allow the inside surface thereof to slide on the outside surface of the corresponding collar 12 when the barrel is in rotation.

In the above first embodiment, the regulating plate 46 used to regulate the position of each lead wire 10 is fixed to the corresponding energizing member 5 with the screw 47. Alternatively, if the screw 47 similar to the above is adapted to fix the above regulating plate 46 to each support shaft 4 (specifically, each connection part cover 41), the same effects may be produced.

In each of the above embodiments, the downwardly bent part 101 of each lead wire 10 is of the inclined linear shape. Alternatively, the downwardly bent part 101 may be a circular arc or polygonal-shaped part having a convex shape that is off to an upper or lower part of the above downwardly bent part.

According to the barrel plating device of the present invention, the collar 12 formed with the low friction member is mounted to each lead wire 10 in the bearing portion where the above lead wire 10 pierces through the corresponding end plate 31 of the barrel 3, so that it is possible to protect the insulation layer 104 of the above lead wire 10 that is at the above bearing portion. In addition, the collar 12 and the insulation layer 104 of each lead wire 10 are the separate members, so that the selection of the material having satisfactory workability and low coefficient of thermal expansion for the above collar may be adapted to easily control the clearance size of the above bearing portion to ensure that the small works or the part thereof may not enter the clearance of the above bearing portion.

The collar 12 and the lead wire 10 are the separate members, so that easy replacement of the collar 12 is executable.

What is claimed is:

1. A barrel plating device, comprising:

support members facing each other across a prescribed space;

hollow support shafts approximately level with each other, said hollow support shafts being respectively mounted in and extending through said support members, each of said hollow support shafts having a large inner diameter bore at one end and a small inner diameter bore, said large inner diameter bore having an internal circumferentially extending groove;

a plating barrel having a hollow drum portion and end plates closing opposite ends of said drum portion, said end plates each having a central boss said barrel having opposite ends rotatably supported by said support shafts respectively inserted into the bosses;

lead wires, each lead wire having an electrode at a tip end and coated with an insulation layer, each of said lead wires extending through a bore of a support shaft and held therein watertight and against rotation in a manner allowing said lead wire to extend through the corresponding end plate of said plating barrel and into communication with the interior of said hollow drum portion; and a bush formed of a low friction material and mounted within each central boss;

a collar formed of a low friction material, said collar being fixed to a portion of each lead wire within and in sliding contact with the bush in a manner allowing rotation of the bush together with the barrel relative to said collar, said collar having a slotted portion with a plurality of slots axially extending from an end thereof facing a hollow support shaft, said slotted portion extending into said large diameter bore and having an outer circumferential projection engaged within said groove.

2. The barrel plating device according to claim 1, wherein the inner diameter of said slotted portion of said collar is slightly larger than the inner diameter of the remaining portion of said collar.

3. The barrel plating device according to claim 1, wherein each of said bosses defines an insertion hole and has a circumferential groove around the insertion hole said bush has a slotted portion with slots axially extending from an end facing the barrel, said slotted portion of said bush has an inner diameter larger than the inner diameter of the remaining portion and a projection around its outer circumference engaged within and held by the circumferential groove around the insertion hole.

4. The barrel plating device according to claim 1, wherein each lead wire is a hard conductive bar including horizontal shaft portion inserted into a bore of a corresponding support shaft and a downwardly bent portion integral with said shaft portion and slanting downward within said plating barrel, said shaft portion has a bare portion including a connection portion at a distal end, said downwardly bent portion has an electrode at a tip end, said lead wire, excepting said connection portion, and said electrode are coated with an insulation layer, an energizing member is connected to the connection part of each lead wire, and the connection between said connection portion and said energizing member is covered with insulation in a watertight condition.

5. The barrel plating device according to claim 4, wherein said plating barrel is mounted on said support shafts so as to be vertically inclined relative to a rotation axis by a prescribed angle.

6. The barrel plating device according to claim 5, where said barrel is mounted on said support shafts so as to be horizontally inclined by a prescribed angle relative to the rotation axis.

7. The barrel plating device according to claim 4, wherein the electrodes of said lead wires are located within the barrel facing each other at a level lower than the rotation axis of the barrel and are inclined by a prescribed angle in a direction of rotation.

8. The barrel plating device according to claim 5, wherein the bare portion additionally includes a non-circular portion of a non-circular sectional shape located adjacent said connection portion, said non-circular portion is seated within a mating opening in a regulating plate, whereby said regulating plate and the shaft part of the lead wire rotate as a unit, and said regulating plate is fixed to said energizing member or said support shaft with a screw to fix said electrode in a position below and inclined by a prescribed angle relative to the rotational axis of the barrel.

9. The barrel plate device according to claim 8, wherein said regulating plate has a plurality of screw insertion holes radially spaced at prescribed angles from the center of the mating opening, and a selected one of said screw insertion holes is used to fix said regulating plate to said energizing member or said support shaft with the screw.

* * * * *